US012098453B2

(12) United States Patent
Zhong et al.

(10) Patent No.: US 12,098,453 B2
(45) Date of Patent: Sep. 24, 2024

(54) 6$^{xxx}$ SERIES ALUMINUM ALLOY, METHOD FOR MANUFACTURING THE SAME, AND MOBILE TERMINAL

(71) Applicant: GUANGDONG ZHONGSE YANDA NEW MATERIALS TECHNOLOGY CO., LTD., Dongguan (CN)

(72) Inventors: Hao Zhong, Dongguan (CN); Ming Song, Dongguan (CN); Dabin Yang, Dongguan (CN); Zhongbin Yang, Dongguan (CN)

(73) Assignee: GUANGDONG ZHONGSE YANDA NEW MATERIAL TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/955,020

(22) PCT Filed: May 20, 2020

(86) PCT No.: PCT/CN2020/091314

§ 371 (c)(1),
(2) Date: Jun. 17, 2020

(87) PCT Pub. No.: WO2021/155648

PCT Pub. Date: Aug. 12, 2021

(65) Prior Publication Data

US 2022/0372605 A1 Nov. 24, 2022

(30) Foreign Application Priority Data

Feb. 6, 2020 (CN) ..... 202010081810.X

(51) Int. Cl.

| | |
|---|---|
| ***C22F 1/05*** | (2006.01) |
| ***C22C 21/02*** | (2006.01) |
| ***C22C 21/08*** | (2006.01) |

(52) U.S. Cl.
CPC ..... *C22F 1/05* (2013.01); *C22C 21/02* (2013.01); *C22C 21/08* (2013.01)

(58) Field of Classification Search
None
See application file for complete search history.

(56) References Cited

U.S. PATENT DOCUMENTS

2017/0175239 A1* 6/2017 Ahmed ..... C22C 21/06
2018/0171449 A1* 6/2018 Skubich ..... C22F 1/05
(Continued)

FOREIGN PATENT DOCUMENTS

CN 107385290 A 11/2017
CN 107475582 A 12/2017
(Continued)

*Primary Examiner* — George Wyszomierski
*Assistant Examiner* — Janell C Morillo
(74) *Attorney, Agent, or Firm* — CANTOR COLBURN LLP

(57) ABSTRACT

The present application relates to the technical field of aluminum alloy, and more particularly to a 6××× series aluminum alloy, including: 0.7-1.1 wt. % of magnesium, 0.5-1.1 wt. % of silicon, 0.5-1.0 wt. % of copper, 0<manganese≤0.15 wt. %, 0<iron≤0.1 wt. %, 0<chromium≤0.1 wt. %, 0<titanium≤0.05 wt. %, less than or equal to 0.05 wt. % of zinc, and a balance of aluminum. A total weight percentage of Mn, Cr, and Ti is 0.02-0.25 wt. %, and a total weight percentage of Mn and Fe is 0.02-0.2 wt. %. The 6××× series aluminum alloy provided by the present application has excellent mechanical properties, including tensile strength and yield strength, as well as good plasticity, high corrosion resistance, and good welding processability.

7 Claims, 6 Drawing Sheets

(56) References Cited

U.S. PATENT DOCUMENTS

| | | | |
|---|---|---|---|
| 2019/0010591 | A1 | 1/2019 | Das et al. |
| 2019/0169717 | A1 | 6/2019 | Li et al. |
| 2019/0352759 | A1 | 11/2019 | Despois et al. |

FOREIGN PATENT DOCUMENTS

| | | | | |
|---|---|---|---|---|
| CN | 108300884 | A | | 7/2018 |
| CN | 108950324 | A | * | 12/2018 |
| CN | 109136670 | A | | 1/2019 |
| CN | 109487134 | A | | 3/2019 |
| JP | 2017179456 | A | | 10/2017 |
| KR | 101642850 | B1 | | 7/2016 |

* cited by examiner

6xxx SERIES ALUMINUM ALLOY, METHOD FOR MANUFACTURING THE SAME, AND MOBILE TERMINAL This application claims the priority of Chinese Patent Application No. 202010081810. X filed on Feb. 6, 2020 with CNIPA, titled as "6××× series aluminum alloy, method for manufacturing the same, and mobile terminal", the contents of which are incorporated herein by reference. This application is a U.S. National Stage of International Patent Application No. PCT/CN2020/091314, filed on May 20, 2020, which claims the priority of Chinese Patent Application No. 202010081810.X, filed on Feb. 6, 2020, the entire contents of which are incorporated herein by reference in its entireties.

BACKGROUND

1. Technical Field

The present application relates to the technical field of aluminum alloy, and more particularly to a 6××× series aluminum alloy, a method for manufacturing the same, and a mobile terminal.

2. Related Art

A 6××× series aluminum alloy has relatively high strength, and when as well as better plasticity, corrosion resistance, and welding processability when compared to a 7 series aluminum alloy, thus being widely used in military and civil fields. The main strengthening methods of 6××× series alloys includes: solid solution strengthening, aging strengthening, and grain refinement strengthening. In some related technologies, by controlling the equiaxed grain size of the 6××× series aluminum alloy, the grain size is refined to improve the yield strength of the aluminum alloy material, but this method can only increase the yield strength of the 6××× series aluminum alloy to about 300 MPa, which is still the achievable strength of conventional 6××× series aluminum alloy. In other related technologies, the content of strengthening phase is increased by increasing the contents of main alloy elements including Mg, Si and Cu and the content of trace elements including Mn, Cr and Zr, thereby increasing the yield strength of aluminum alloy materials to 400 MPa. However, adding too much Mg, Si, and Cu elements will form a large amount of coarse $Mg_2Si$ phase in the material, which is not conducive to the subsequent sufficient dissolution of these phases. Increasing the content of trace elements can easily form a large amount of Fe-containing phases, reduce the plasticity or fatigue performance of materials, and increase manufacturing costs. In addition, the blind increase of Mg, Si, Cu and trace elements of Mn, Cr, and Zr will also adversely affect other properties of the material such as thermal conductivity and anode performance. Therefore, the mechanical properties such as the yield strength and the tensile strength of 6××× series aluminum alloy materials still need to be further improved.

SUMMARY

It is one of the objects of the present application to provide a 6××× series aluminum alloy material, which aims at solving the technical problem that the current 6××× series aluminum alloy material has relatively poor mechanical properties, including the yield strength and the tensile strength, thus restricting the application thereof in the 5G communication field.

Technical Solutions

In order to solve the above technical problems, technical solutions provided by embodiments of the present application are as follows:

A first aspect provides a 6××× series aluminum alloy material, which comprises the following components by weight percentage, based on a total weight of the 6××× series aluminum alloy material being defined as 100 wt. %:

| | |
|---|---|
| Mg | 0.7-1.1 wt. %, |
| Si | 0.5-1.1 wt. %, |
| Cu | 0.5-1.0 wt. %, |
| Mn | ≤0.15 wt. %, with the weight percentage of Mn excluding 0, |
| Fe | ≤0.10 wt. %, with the weight percentage of Fe excluding 0, |
| Cr | ≤0.10 wt. %, with the weight percentage of Cr excluding 0, |
| Ti | ≤0.05 wt. %, with the weight percentage of Ti excluding 0, |
| Zn | ≤0.05 wt. %, and |

the balance being Al; wherein a total weight percentage of Mn, Cr, and Ti is 0.02-0.25 wt. %, and a total weight percentage of Mn and Fe is 0.02-0.2 wt. %.

A second aspect of the present application provides a method for manufacturing a 6××× series aluminum alloy material, comprising the following steps: collecting metal raw material components according to contents of the metal components in the 6××× series aluminum alloy material as described in the above, casting the metal raw material components, and performing homogenization, cooling, extrusion, and aging sequentially, to yield the 6××× series aluminum alloy material.

A third aspect of the present application provides a mobile terminal, comprising the 6××× series aluminum alloy material as described in the above, or a 6××× series aluminum alloy material prepared according to the method as described in the above.

Beneficial Effects

The 6××× series aluminum alloy material provided by embodiments of the present application comprises: 0.7-1.1 wt. % of magnesium, 0.5-1.1 wt. % of silicon, 0.5-1.0 wt. % of copper, 0<manganese≤0.15 wt. %, 0<iron≤0.1 wt. %, 0<chromium≤0.1 wt. %, 0<titanium≤0.05 wt. %, less than or equal to 0.05 wt. % of zinc, and a balance of aluminum. A total weight percentage of Mn, Cr, and Ti is 0.02-0.25 wt. %, and a total weight percentage of Mn, Cr, Ti, and Fe is 0.02-0.2 wt. %. In the 6××× series aluminum alloy material according to this embodiment of the present application, the 0.7-1.1 wt. % of magnesium and 0.5-1.1 wt. % of silicon are main strengthening elements and form $Mg_2Si$ strengthening phases in the alloy. If contents of magnesium and silicon are too high, a great quantity of $Mg_2Si$ phases exceeding the solid solubility of the matrix would be easily formed in the alloy, which cannot improve the strength of the alloy material, but further decrease the performances including fatigue, fracture, and anodizing of the material; and if the contents of magnesium and silicon are too low, the strengthening effect of the material cannot be effectively improved. Among them, the 0.5-1.0 wt. % of copper can improve the solid solution strengthening effect and the aging strengthening effect of the alloy material, be conducive to the improvement of the work hardening ability of the alloy material, moreover, as well as ensure the corrosion resistance property of the alloy material, improve the stability of the alloy material, and prolong the service life thereof. In case of exceeding addition of copper, the corrosion resistance of the material may easily decrease, and in case of too low the copper content, it is difficult to effectively improve the solid solution strengthening effect, aging strengthening effect, and the work hardening ability. In addition, 0<manganese≤0.15 wt. %, 0<chromium≤0.1 wt. %, 0<titanium≤0.05 wt. %, and 0<iron≤0.1 wt. %, a total weight percentage of Mn, Cr, and Ti is 0.02-0.25 wt. %, and a total weight percentage of Mn and Fe is 0.02-0.2 wt. %. Based on mutual synergetic effect of manganese, chromium, titanium, and iron, fining and controlling the gain structure of the alloy material may enable the alloy material to include the fibrous structure, in addition to the routine equiaxed grain structure in the alloy material. Based on a combined action of the fibrous structure and the equiaxed grain structure, on the one hand, the mechanical property of the alloy material along the fiber direction may be significantly improved, on the other hand, residual stress exists between different kinds of grain structures, and increases the sub-grain degree within the grains during manufacturing and refining the grains, moreover, during plastic deformation of the material, the distortion between different types of grains intensifies, and the mutual interference between dislocations will prevent the movement of dislocations, thereby increasing the plastic deformation resistance of the alloy material and improving the mechanical properties of the alloy material, such as the tensile strength and the yield strength. In addition, the aluminum alloy also has good plasticity, high corrosion resistance, and excellent welding processability.

In the method for manufacturing a 6××× series aluminum alloy material provided by the present application, the raw material components for the 6××× series aluminum alloy material are collected according to the above specific ratio, casted, and performed with homogenization, cooling, extrusion, and aging sequentially, thereby obtaining the 6××× series aluminum alloy material with excellent mechanical properties including the yield strength and the tensile strength. The manufacturing method is simple, and has flexible and convenient operations, which is suitable for industrial and large-scale production and application.

Due to containing the 6××× series aluminum alloy material, which has excellent mechanical properties, good plasticity, high corrosion resistance, good welding processability, wide application field, and has the yield strength of greater than 430 MPa and the tensile strength of greater than 440 MPa, the mobile terminal provided by embodiments of the present application has excellent resistance to external impact, good stability, and long service life.

BRIEF DESCRIPTION OF THE DRAWINGS

In order to more clearly explain the technical solutions in the embodiments of the present application, the following will briefly introduce the drawings needed in the embodiments or exemplary technical descriptions. Obviously, the drawings in the following description are only some embodiments of the present application, those skilled in the art may obtain other drawings based on these drawings without creative efforts.

DETAILED DESCRIPTION OF THE EMBODIMENTS

Figure 1:
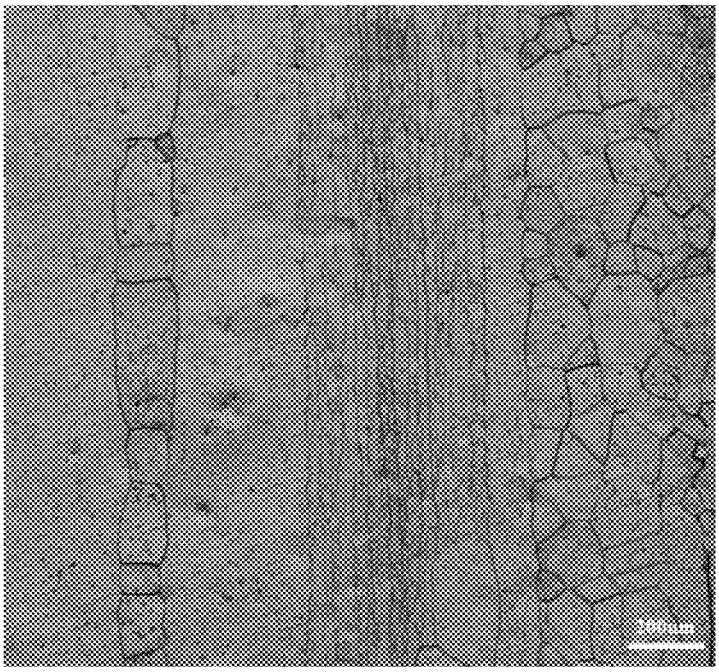
FIG. 1 shows morphology of a crystalline phase structure of a 6××× series aluminum alloy provided by Example 1 of the present application.

In order to make the purposes, technical solutions, and advantages of the present application more clear, the present application will be described in further detail in accompany with the drawings and embodiments. It should be understood that the specific embodiments described herein are only used to explain the present application, rather than limiting the present application.

In order to explain the technical solutions described in the present application, the following detailed description will be made in accompany with specific drawings and embodiments.

Some embodiments of the present application provide a 6××× series aluminum alloy material, based on a total weight of the 6××× series aluminum alloy material being defined as 100 wt. %, comprises the following components by weight percentage:

| | |
|---|---|
| Mg | 0.7-1.1 wt. %, |
| Si | 0.5-1.1 wt. %, |
| Cu | 0.5-1.0 wt. %, |
| Mn | ≤0.15 wt. %, with the weight percentage of Mn excluding 0, |
| Fe | ≤0.10 wt. %, with the weight percentage of Fe excluding 0, |
| Cr | ≤0.10 wt. %, with the weight percentage of Cr excluding 0, |
| Ti | ≤0.05 wt. %, with the weight percentage of Ti excluding 0, |
| Zn | ≤0.05 wt. %, and |

the balance being Al; where a total weight percentage of Mn, Cr, and Ti is 0.02-0.25 wt. %, and a total weight percentage of Mn and Fe is 0.02-0.2 wt. %.

The 6××× series aluminum alloy material provided by embodiments of the present application comprises: 0.7-1.1 wt. % of magnesium, 0.5-1.1 wt. % of silicon, 0.5-1.0 wt. % of copper, 0<manganese≤0.15 wt. %, 0<iron≤0.1 wt. %, 0<chromium≤0.1 wt. %, 0<titanium≤0.05 wt. %, less than or equal to 0.05 wt. % of zinc, and a balance of aluminum. A total weight percentage of Mn, Cr, and Ti is 0.02-0.25 wt. %, and a total weight percentage of Mn and Fe is 0.02-0.2 wt. %. In the 6××× series aluminum alloy material according to this embodiment of the present application, the 0.7-1.1 wt. % of magnesium and 0.5-1.1 wt. % of silicon are main strengthening elements and form $Mg_2Si$ strengthening phases in the alloy. If contents of magnesium and silicon are too high, a great quantity of $Mg_2Si$ phases exceeding the solid solubility of the matrix would be easily formed in the alloy, which cannot improve the strength of the alloy material, but further decrease the performances including fatigue, fracture, and anodizing of the material; and if the contents of magnesium and silicon are too low, the strengthening effect of the material cannot be effectively improved. Among them, the 0.5-1.0 wt. % of copper can improve the solid solution strengthening effect and the aging strengthening effect of the alloy material, be conducive to the improvement of the work hardening ability of the alloy material, moreover, as well as ensure the corrosion resistance property of the alloy material, improve the stability of the alloy material, and prolong the service life thereof. In case of exceeding addition of copper, the corrosion resistance of the material may easily decrease, and in case of too low the copper content, it is difficult to effectively improve the solid solution strengthening effect, aging strengthening effect, and the work hardening ability. In addition, 0<manganese≤0.15 wt. %, 0<chromium≤0.1 wt. %, 0<titanium≤0.05 wt. %, and 0<iron≤0.1 wt. %, a total weight percentage of Mn, Cr, and Ti is 0.02-0.25 wt. %, and a total weight percentage of Mn and Fe is 0.02-0.2 wt. %. Based on mutual synergetic effect of manganese, chromium, titanium, and iron, fining and controlling the gain structure of the alloy material may enable the alloy material to include the fibrous structure, in addition to the routine equiaxed grain structure in the alloy material. Based on a combined action of the fibrous structure and the equiaxed grain structure, on the one hand, the mechanical property of the alloy material along the fiber direction may be significantly improved, on the other hand, residual stress exists between different kinds of grain structures, and increases the sub-grain degree within the grains during manufacturing and refining the grains, moreover, during plastic deformation of the material, the distortion between different types of grains intensifies, and the mutual interference between dislocations will prevent the movement of dislocations, thereby increasing the plastic deformation resistance of the alloy material and improving the mechanical properties of the alloy material, such as the tensile strength and the yield strength. In addition, the aluminum alloy also has good plasticity, high corrosion resistance, and excellent welding processability.

Specifically, in the 6××× series aluminum alloy material, 0<titanium≤0.05 wt. % functions in refining the size of the casting grain, while too much of titanium will form a great quantity of accumulated Ti-containing phases in the structure, thereby lowering the extrusion molding performance of the material. 0<manganese≤0.15 wt. % and 0<chromium≤0.1 wt. % primarily function in refining or controlling the deformed grain structure, where Mn and Cr form dispersed precipitation phases, which controls the migration of grains during the deformation process and in turn control the grain structure of the material, and the size of the Mn containing dispersoid phase is usually smaller than that of the Cr containing dispersoid. Through the mutual doping of the Mn containing dispersoid and Cr containing dispersoid with different sizes is conducive to the better control of the grain structure and grain size of the alloy material. If the contents of manganese and chromium are too high, the formation of a large number of dispersoids in the structure of the alloy material will deteriorate the processability of the material and decrease the mechanical properties of the material. The total weight percentage of Mn, Cr, and Ti is 0.02-0.25 wt. %, and manganese, chromium, and titanium of such contents are conducive to better control of the grain structure and grain size of the alloy materials. Based on a combined action of 0<iron≤0.1 wt. %, manganese, chromium, and titanium, the grain structure can be adjusted and changed. The total weight percentage of Mn and Fe is controlled at 0.02-0.2 wt. %, which enables the alloy material to contain the equiaxed grain structure and the fibrous structure. Based on the combined action of the fibrous structure and the equiaxed grain structure, the mechanical performance of the alloy material is improved. Among them, zinc≤0.05 wt. %, and by controlling the content of zinc element in the alloy, the corrosion resistance of the alloy material is effectively ensured. If the metal zinc content is too high, the corrosion resistance of the alloy material will be lowered.

In some embodiments of the present application, the 6××× series aluminum alloy material, based on the definition of the total weight of the 6××× series aluminum alloy material being 100 wt. %, comprises the following components by weight percentage:

| | |
|---|---|
| Mg | 0.7-1.1 wt. %, |
| Si | 0.6-0.9 wt. %, |
| Cu | 0.5-1.0 wt. %, |
| Mn | 0.01-0.09 wt. %, |
| Fe | 0.01-0.09 wt. %, |
| Cr | ≤0.05 wt. %, with the weight percentage of Cr excluding 0, |
| Ti | ≤0.05 wt. %, with the weight percentage of Ti excluding 0, |
| Zn | ≤0.05 wt. %, and |

the balance being Al; where the total weight percentage of Mn, Cr, and Ti is 0.02-0.15 wt. %, and the total weight percentage of Mn and Fe is 0.02-0.1 wt. %, with the total weight percentage of Mn and Fe excluding 0.1 wt. %.

In embodiments of the present application, the ratio among the metal elements of the aluminum alloy material are adjusted, such that the grain structure and grain size of the alloy material are optimized, the alloy material has better mechanical properties, including the yield strength and tensile strength, good plasticity, high corrosion resistance, excellent welding processability, and wide application range.

In some embodiments, the 6××× series aluminum alloy material comprises an equiaxed grain structure and a fibrous structure and a volume ratio of the equiaxed grain structure to the fibrous structure is 1: (0.5-1.5). The 6××× series aluminum alloy material provided by embodiments of the present application contains the volume ratio of the equiaxed grain structure to the fibrous structure of 1: (0.5-1.5), by the combined action of the fibrous structure and the equiaxed grain structure in such proportion, the sub-grain degree within the grains is increased, the grains are refined, the dislocation movement of the grain structures are avoided, therefore, the plastic deformation resistance of the alloy material is increased, the mechanical properties, including the tensile strength and the yield strength of the alloy material are improved.

The 6××× series aluminum alloy material provided by embodiments of the present application has a yield strength of greater than 430 MPa and a tensile strength of greater than 440 MPa, thus having excellent mechanical properties, good plasticity, high corrosion resistance, good welding processability, wide application field, and being particularly applicable to the field of the mobile terminal, for example, mobile terminals based on 5G communication technology, as a shell material for the mobile terminal. Such a shell material has a high degree of adaptability with the current flexible display curved surface technology, thereby being capable of providing better protection for the mobile terminal, improving its resistance against the external impacts, and extending its service life.

The 6××× series aluminum alloy material provided by embodiments of the present application may be manufactured according to the following method.

A method for manufacturing a 6××× series aluminum alloy material is also provided by embodiments of the present application, comprises: collecting metal raw material components according to contents of the metal components in the 6××× series aluminum alloy material provided by any of the above embodiments, casting the metal raw material components, and performing homogenization, cooling, extrusion, and aging sequentially, to yield the 6××× series aluminum alloy material.

In the method for manufacturing a 6××× series aluminum alloy material provided by the embodiment of the present application, the raw material components for the 6××× series aluminum alloy material are collected according to the above specific ratio, casted, and performed with homogenization, cooling, extrusion, and aging sequentially, thereby obtaining the 6××× series aluminum alloy material with excellent mechanical properties including the yield strength and the tensile strength. The manufacturing method is simple, and has flexible and convenient operations, which is suitable for industrial and large-scale production and application.

In some embodiments, the step of homogenization comprises keeping metal materials after the casting at a temperature of 570-580° C. for 2-10 hrs. In this embodiment of the present application, the homogenization treatment facilitates the dissolution of $Mg_2Si$ in the as-cast structure, and provides structure preparation for subsequent aging strengthening. The homogeneous heating method may adopt a single-stage mode or a multi-stage mode.

In some specific embodiments, the step of keeping metal materials after the casting at a temperature of 570-580° C. for 2-10 hrs comprises: increasing a temperature of the metal materials after the casting to 480-540° C. within 2-12 hrs and keeping such temperature for 2-6 hrs; increasing the temperature to be 540-570° C. within 4-10 hrs; and then increasing the temperature to 570-580° C. and then keeping such temperature for 2-10 hrs. In the embodiment of the present application, the homogenization treatment adopts a three-step heating mode, which can dissolve different melting point phases in stages in different heating processes, thus avoiding over-burning and improving the performance of the material.

In some embodiments, the step of cooling comprises: cooling the metal materials after homogenization at below 300° C. within 3-8 hrs. In the embodiment of the present application, the metal material is cooled to 300° C. below within 3-8 hours, which effectively prevents the precipitation of intermetallic $Mg_2Si$ and other compounds during the cooling process. If the cooling is too slow, relatively large $Mg_2Si$ phases are easily precipitated, which affects the grain structure and size and reduces the mechanical properties of the material.

In some embodiments, the step of extrusion comprises: extruding the metal materials after the cooling under such conditions: an extruded rod temperature of 510-580° C., an extrusion speed of 3-5 m/min, and an outlet temperature of 520-570° C. In the embodiments of the present application, by adjusting and controlling the conditions including the extrusion rod temperature, extrusion speed, outlet temperature during the extrusion process, the tissue preparation is provided for the metal material for the subsequent aging process. If the extrusion rod temperature is lower than 510° C., a low outlet temperature and low mechanical properties of the material may be resulted, and if the extrusion rod temperature is higher than 580° C., the material tends to be over-burnt and difficult to form. The control of the extrusion speed is mainly to ensure the production efficiency and to control the precipitation of the $Mg_2Si$ phase during the extrusion process, and is preferably 3-15 m/min. The control of the outlet temperature is mainly to control the mechanical properties of the material and the precipitation of the $Mg_2Si$ phase. When the outlet temperature is below 520° C., the mechanical properties of the material are insufficient and a large amount of undissolved $Mg_2Si$ phase exist in the structure. When the outlet temperature is higher than 565° C., relatively coarse grain structure and fracture of the material will be resulted.

In some embodiments, the step of aging comprises: keeping the metal materials after the extrusion at 170-200° C. for 2-24 hrs. In the embodiments of the present application, the metal materials after the extrusion is kept at 170-200° C. for 2-24 hrs, and $Mg_2Si$ phases are precipitated during the aging process to form the composite grain structure containing the equiaxed grain structure and the fibrous structure, which improves the mechanical properties of the material. If the temperature is too high, the material tends to be over-aged, resulting in insufficient mechanical performance; and if the temperature is too low, the material tends to be under-aged, also resulting in insufficient mechanical performance. In addition, too short the processing time will result in under-aging, and too long the processing time will result in over-aging. Only when the aging process is performed under the above conditions, the material can obtain better mechanical properties.

In some specific embodiments, the method for manufacturing the 6××× series aluminum alloy material includes the following steps:

S10: collecting the following raw material components by weight percentage, based on a total weight of the 6××× series aluminum alloy material being defined as 100 wt. %:

| | |
|---|---|
| Mg | 0.7-1.1 wt. %, |
| Si | 0.5-1.1 wt. %, |
| Cu | 0.5-1.0 wt. %, |
| Mn | ≤0.15 wt. %, with the weight percentage of Mn excluding 0, |
| Fe | ≤0.10 wt. %, with the weight percentage of Fe excluding 0, |
| Cr | ≤0.10 wt. %, with the weight percentage of Cr excluding 0, |
| Ti | ≤0.05 wt. %, with the weight percentage of Ti excluding 0, |
| Zn | ≤0.05 wt. %, and |

the balance being Al; where a total weight percentage of Mn, Cr, and Ti is 0.02-0.25 wt. %, and a total weight percentage of Mn and Fe is 0.02-0.2 wt. %.

S20: increasing a temperature of the metal materials after the casting to 480-540° C. within 2-12 hrs and keeping such temperature for 2-6 hrs; increasing the temperature to be 540-570° C. within 4-10 hrs; and then increasing the temperature to 570-580° C. and then keeping such temperature for 2-10 hrs.

S30: cooling the metal materials after homogenization to below 300° C. within 3-8 hrs.

S40: extruding the metal materials after the cooling under such conditions: an extruded rod temperature of 510-580° C., an extrusion speed of 3-5 m/min, and an outlet temperature of 520-570° C.

S50: keeping the metal materials after the extrusion at 170-200° C. for 2-24 hrs.

The 6××× series aluminum alloy material provided by embodiments of the present application has a yield strength of greater than 430 MPa and a tensile strength of greater than 440 MPa, thus having excellent mechanical properties, good plasticity, high corrosion resistance, good welding processability, wide application field, and being particularly applicable to the field of the mobile terminal, for example, mobile terminals based on 5G communication technology, as a shell material for the mobile terminal. Such a shell material has a high degree of adaptability with the current flexible display curved surface technology, thereby being capable of providing better protection for the mobile terminal, improving its resistance against the external impacts, and extending its service life.

Accordingly, embodiments of the present application provide a mobile terminal, comprising the above 6××× series aluminum alloy material.

Due to containing the 6××× series aluminum alloy material, which has excellent mechanical properties, good plasticity, high corrosion resistance, good welding processability, wide application field, and has the yield strength of greater than 430 MPa and the tensile strength of greater than 440 MPa, the mobile terminal provided by embodiments of the present application has excellent resistance to external impact, good stability, and long service life.

In some specific embodiments, the mobile terminal is a mobile terminal based on 5G communication technology. The 6××× series aluminum alloy material provided by embodiments of the present application has good plasticity, high corrosion resistance, good welding processability, as well as excellent mechanical properties. The yield strength is greater than 430 MPa and the tensile strength is greater than 440 MPa, thus being capable of satisfying the mobile terminal based on the 5G communication technology for the high-performance demand on the alloy material. In addition, the 6××× series aluminum alloy material has a high degree of adaptability with the flexible display curved surface technology, thereby being capable of providing better protection for the mobile terminal, improving its resistance against the external impacts, and extending its service life.

In order to make the above-mentioned implementation details and operations of this application clearly understood by those skilled in the art, and to emphasize the improvements of the 6××× series aluminum alloy material and the method for manufacturing the same provided by this application, the above technical solutions are illustrated in accompany with a plurality of examples.

EXAMPLE 1

A 6××× series aluminum alloy material, comprised the following components by weight percentage, based on a total weight of the 6××× series aluminum alloy material being defined as 100 wt. %: 0.7 wt. % of Mg, 1.1 wt. % of Si, 1.0 wt. % of Cu, 0.10 wt. % of Mn, 0.10 wt. % of Cr, 0.05 wt. % of Ti, 0.10 wt. % of Fe, and 0.05 wt. % of Zn.

The manufacturing steps were as follows: an ingot was firstly homogenized and annealed, in which, the ingot was kept at 580° C. for 10 hrs, then a homogenized ingot was transferred to a cooling chamber and cooled to 300° C. below within 8 hrs. Thereafter, a resulting ingot was extruded under the following conditions: an extruded rod temperature of 510° C., an extrusion speed of 15 m/min, and an outlet temperature of 565° C. Finally, aging processing was conducted by keeping a resulting ingot at 175° C. for 24 hrs.

EXAMPLE 2

A 6××× series aluminum alloy material, comprised the following components by weight percentage, based on a total weight of the 6××× series aluminum alloy material being defined as 100 wt. %: 1.1 wt. % of Mg, 0.5 wt. % of Si, 0.5 wt. % of Cu, 0.01 wt. % of Mn, 0.05 wt. % of Cr, 0.04 wt. % of Ti, 0.02 wt. % of Fe, and 0.02 wt. % of Zn.

The manufacturing steps were as follows: an ingot was firstly homogenized and annealed, in which, the ingot was kept at 570° C. for 2 hrs, then a homogenized ingot was transferred to a cooling chamber and cooled to 300° C. below within 3 hrs. Thereafter, a resulting ingot was extruded under the following conditions: an extruded rod temperature of 580° C., an extrusion speed of 3 m/min, and an outlet temperature of 520° C. Finally, aging processing was conducted by keeping a resulting ingot at 200° C. for 2 hrs.

EXAMPLE 3

A 6××× series aluminum alloy material, comprised the following components by weight percentage, based on a total weight of the 6××× series aluminum alloy material being defined as 100 wt. %: 1 wt. % of Mg, 0.8 wt. % of Si, 0.7 wt. % of Cu, 0.08 wt. % of Mn, 0.03 wt. % of Cr, 0.04 wt. % of Ti, 0.04 wt. % of Fe, and 0.02 wt. % of Zn.

The manufacturing steps were as follows: an ingot was firstly homogenized and annealed, in which, the ingot was kept at 575° C. for 8 hrs, then a homogenized ingot was transferred to a cooling chamber and cooled to 300° C. below within 6 hrs. Thereafter, a resulting ingot was extruded under the following conditions: an extruded rod temperature of 560° C., an extrusion speed of 8 m/min, and an outlet temperature of 540° C. Finally, aging processing was conducted by keeping a resulting ingot at 180° C. for 12 hrs.

EXAMPLE 4

A 6××× series aluminum alloy material, comprised the following components by weight percentage, based on a total weight of the 6××× series aluminum alloy material being defined as 100 wt. %: 0.95 wt. % of Mg, 0.75 wt. % of Si, 0.65 wt. % of Cu, 0.12 wt. % of Mn, 0.02 wt. % of Cr, 0.03 wt. % of Ti, 0.04 wt. % of Fe, and 0.01 wt. % of Zn.

The manufacturing steps were as follows: an ingot was firstly heated to 535° C. within 12 hrs and followed with a first-stage insulation for 6 hrs, heated to 568° C. for a second-stage insulation for 10 hrs, and then heated to 570° C. for a third-stage insulation for 10 hrs. After that, a homogenized ingot was transferred to a cooling chamber and cooled to 300° C. below within 5 hrs. Thereafter, a resulting ingot was extruded under the following conditions: an extruded rod temperature of 562° C., an extrusion speed of 9 m/min, and an outlet temperature of 545° C. Finally, aging processing was conducted by keeping a resulting ingot at 185° C. for 12 hrs.

EXAMPLE 5

A 6××× series aluminum alloy material, comprised the following components by weight percentage, based on a total weight of the 6××× series aluminum alloy material being defined as 100 wt. %: 0.95 wt. % of Mg, 0.75 wt. % of Si, 0.65 wt. % of Cu, 0.02 wt. % of Mn, 0.02 wt. % of Cr, 0.03 wt. % of Ti, 0.05 wt. % of Fe, and 0.01 wt. % of Zn.

The manufacturing steps were as follows: an ingot was firstly heated to 480° C. within 2 hrs and followed with a first-stage insulation for 2 hrs, heated to 540° C. for a second-stage insulation for 4 hrs, and then heated to 580° C.

for a third-stage insulation for 2 hrs. After that, a homogenized ingot was transferred to a cooling chamber and cooled to 300° C. below within 5 hrs. Thereafter, a resulting ingot was extruded under the following conditions: an extruded rod temperature of 555° C., an extrusion speed of 7 m/min, and an outlet temperature of 540° C. Finally, aging processing was conducted by keeping a resulting ingot at 175° C. for 16 hrs.

EXAMPLE 6

A 6××× series aluminum alloy material, comprised the following components by weight percentage, based on a total weight of the 6××× series aluminum alloy material being defined as 100 wt. %: 0.95 wt. % of Mg, 0.75 wt. % of Si, 0.65 wt. % of Cu, 0.02 wt. % of Mn, 0.02 wt. % of Cr, 0.03 wt. % of Ti, 0.05 wt. % of Fe, and 0.01 wt. % of Zn.

The manufacturing steps were as follows: an ingot was firstly heated to 530° C. within 5 hrs and followed with a first-stage insulation for 5 hrs, heated to 565° C. for a second-stage insulation for 4 hrs, and then heated to 575° C. for a third-stage insulation for 8 hrs. After that, a homogenized ingot was transferred to a cooling chamber and cooled to 300° C. below within 4 hrs. Thereafter, a resulting ingot was extruded under the following conditions: an extruded rod temperature of 555° C., an extrusion speed of 7 m/min, and an outlet temperature of 540° C. Finally, aging processing was conducted by keeping a resulting ingot at 175° C. for 16 hrs.

COMPARATIVE EXAMPLE 1

An aluminum alloy material, comprised the following components by weight percentage, based on a total weight of the aluminum alloy material: 1.2 wt. % of Mg, 0.5 wt. % of Si, 0.3 wt. % of Cu, 0.40 wt. % of Mn, 0.16 wt. % of Cr, 0.12 wt. % of Ti, 0.18 wt. % of Fe, 0.2 wt. % of Zr, and 0.31 wt. % of Zn.

The manufacturing steps were as follows: an ingot was firstly homogenized and annealed, in which, the ingot was heated to 550° C. within 6 hrs and kept at such temperature for 12 hrs. Then, a homogenized ingot was transferred to a cooling chamber and cooled to 200° C. below within 6 hrs. Thereafter, a resulting ingot was extruded under the following conditions: an extruded rod temperature of 540° C., an extrusion speed of 8 m/min, and an outlet temperature of 550° C. Finally, aging processing was conducted by keeping a resulting ingot at 180° C. for 8 hrs.

COMPARATIVE EXAMPLE 2

An aluminum alloy material, comprised the following components by weight percentage, based on a total weight of the aluminum alloy material: 1.05 wt. % of Mg, 0.80 wt. % of Si, 0.85 wt. % of Cu, 0.15 wt. % of Mn, 0.01 wt. % of Cr, 0.03 wt. % of Ti, 0.20 wt. % of Fe, 0 wt. % of Zr, and 0.01 wt. % of Zn.

The manufacturing steps were as follows: an ingot was firstly homogenized and annealed, in which, the ingot was heated to 550° C. within 6 hrs and kept at such temperature for 12 hrs. Then, a homogenized ingot was transferred to a cooling chamber and cooled to 200° C. below within 6 hrs. Thereafter, a resulting ingot was extruded under the following conditions: an extruded rod temperature of 540° C., an extrusion speed of 8 m/min, and an outlet temperature of 550° C. Finally, aging processing was conducted by keeping a resulting ingot at 180° C. for 8 hrs.

COMPARATIVE EXAMPLE 3

An aluminum alloy material, comprised the following components by weight percentage, based on a total weight of the aluminum alloy material: 1.2 wt. % of Mg, 0.5 wt. % of Si, 0.3 wt. % of Cu, 0.40 wt. % of Mn, 0.16 wt. % of Cr, 0.12 wt. % of Ti, 0.18 wt. % of Fe, 0.2 wt. % of Zr, and 0.31 wt. % of Zn.

The manufacturing steps were as follows: an ingot was firstly homogenized and annealed, in which, the ingot was heated to 510° C. within 4 hrs and followed with a first-stage insulation for 4 hrs, heated to 568° C. for a second-stage insulation for 7 hrs, and then heated to 580° C. for a third-stage insulation for 7 hrs. After that, a homogenized ingot was transferred to a cooling chamber and cooled to 200° C. below within 5 hrs. Thereafter, a resulting ingot was extruded under the following conditions: an extruded rod temperature of 560° C., an extrusion speed of 6 m/min, and an outlet temperature of 550° C. Finally, aging processing was conducted by keeping a resulting ingot at 180° C. for 12 hrs.

COMPARATIVE EXAMPLE 4

An aluminum alloy material, comprised the following components by weight percentage, based on a total weight of the aluminum alloy material: 1 wt. % of Mg, 0.6 wt. % of Si, 0.2 wt. % of Cu, 0.05 wt. % of Mn, 0.22 wt. % of Cr, 0.03 wt. % of Ti, 0.60 wt. % of Fe, and 0.01 wt. % of Zn.

The manufacturing steps were as follows: an ingot was firstly homogenized and annealed, in which, the ingot was heated to 510° C. within 4 hrs and followed with a first-stage insulation for 4 hrs, heated to 568° C. for a second-stage insulation for 7 hrs, and then heated to 580° C. for a third-stage insulation for 7 hrs. After that, a homogenized ingot was transferred to a cooling chamber and cooled to 200° C. below within 5 hrs. Thereafter, a resulting ingot was extruded under the following conditions: an extruded rod temperature of 560° C., an extrusion speed of 6 m/min, and an outlet temperature of 550° C. Finally, aging processing was conducted by keeping a resulting ingot at 180° C. for 12 hrs.

COMPARATIVE EXAMPLE 5

An aluminum alloy material, comprised the following components by weight percentage, based on a total weight of the aluminum alloy material: 1.2 wt. % of Mg, 0.7 wt. % of Si, 0.2 wt. % of Cu, 0.10 wt. % of Mn, 0.1 wt. % of Cr, 0.12 wt. % of Ti, and 0.18 wt. % of Fe.

The manufacturing steps were as follows: an ingot was firstly homogenized and annealed, in which, the ingot was heated to 550° C. within 6 hrs and kept at such temperature for 12 hrs. Then, a homogenized ingot was transferred to a cooling chamber and cooled to 200° C. below within 6 hrs. Thereafter, a resulting ingot was extruded under the following conditions: an extruded rod temperature of 540° C., an extrusion speed of 8 m/min, and an outlet temperature of 550° C. Finally, aging processing was conducted by keeping a resulting ingot at 180° C. for 8 hrs.

To demonstrate the improvements of the 6××× series aluminum alloy materials manufactured by Examples 1-6 of the present application, the mechanical properties of the 6××× series aluminum alloy material prepared in Example 1-6 and the aluminum alloy material prepared in Comparative Example 1-5, such as the yield strength, tensile strength, and percentage elongation after fracture, were tested according to GB/T 228-2010 "Metallic materials; Tensile test; and Room temperature test method", and the test results are shown in Table 1 below:

TABLE 1

| | Mechanical properties | | |
|---|---|---|---|
| | Yield strength/MPa | Tensile strength/MPa | Percentage elongation after fracture/% |
| Example 1 | 432 | 441 | 5 |
| Example 2 | 442 | 449 | 3 |
| Example 3 | 434 | 447 | 4 |
| Example 4 | 433 | 445 | 3 |
| Example 5 | 442 | 450 | 4 |
| Example 6 | 440 | 451 | 3 |
| Comparative Example 1 | 410 | 432 | 8 |
| Comparative Example 2 | 378 | 392 | 6 |
| Comparative Example 3 | 421 | 432 | 4 |
| Comparative Example 4 | 356 | 381 | 6 |
| Comparative Example 5 | 230 | 310 | 5 |

It can be known from the above test results that the 6××× series aluminum alloy materials provided in Example 1-6 of the present application all have a yield strength greater than 430 MPa and a tensile strength greater than 440 MPa, which has excellent mechanical properties. As shown in Comparative Example 1-5, when the percentage of certain metals in the alloy material is changed, or other trace elements are added, the mechanical properties such as the yield strength and the tensile strength of the aluminum alloy material are significantly reduced.

Figure 2:
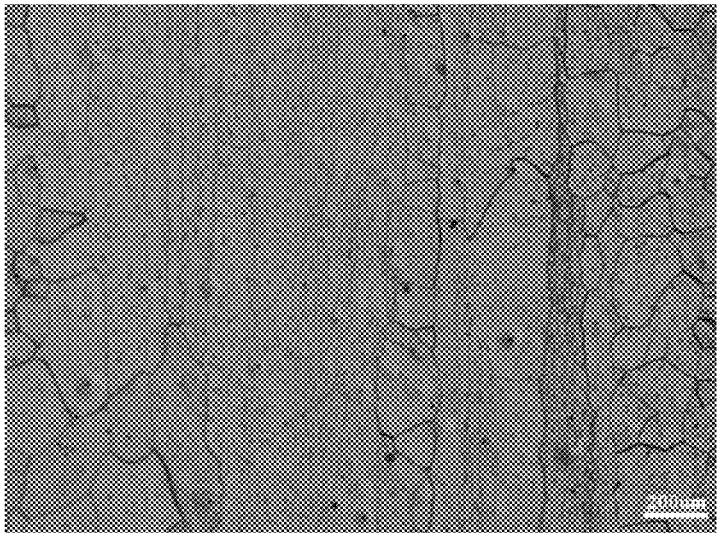
FIG. 2 shows morphology of a crystalline phase structure of a 6××× series aluminum alloy provided by Example 2 of the present application.
Figure 3:
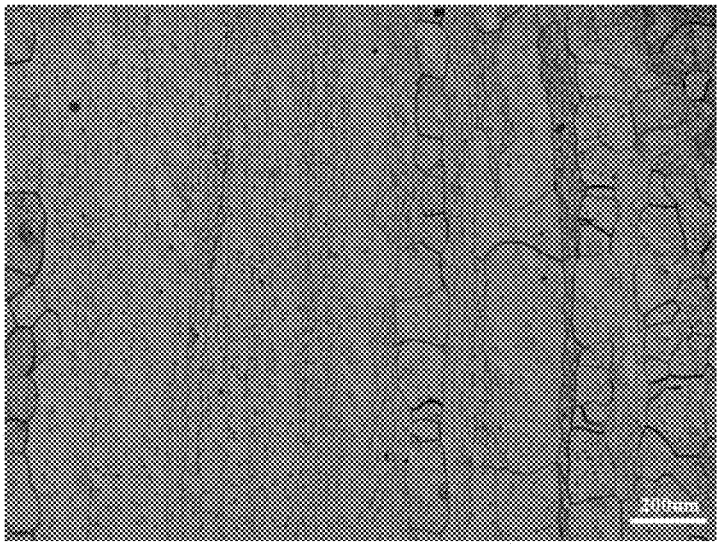
FIG. 3 shows morphology of a crystalline phase structure of a 6××× series aluminum alloy provided by Example 3 of the present application.
Figure 4:
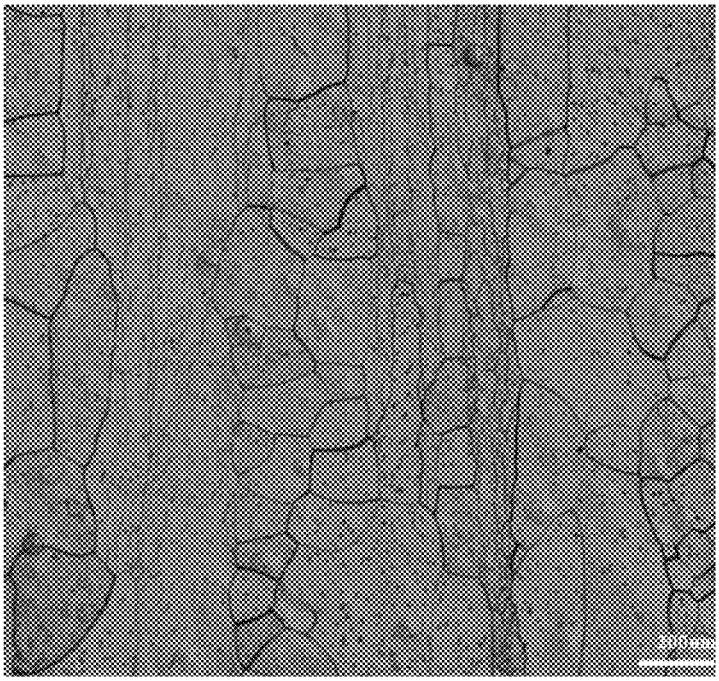
FIG. 4 shows morphology of a crystalline phase structure of a 6××× series aluminum alloy provided by Example 4 of the present application.
Figure 5:
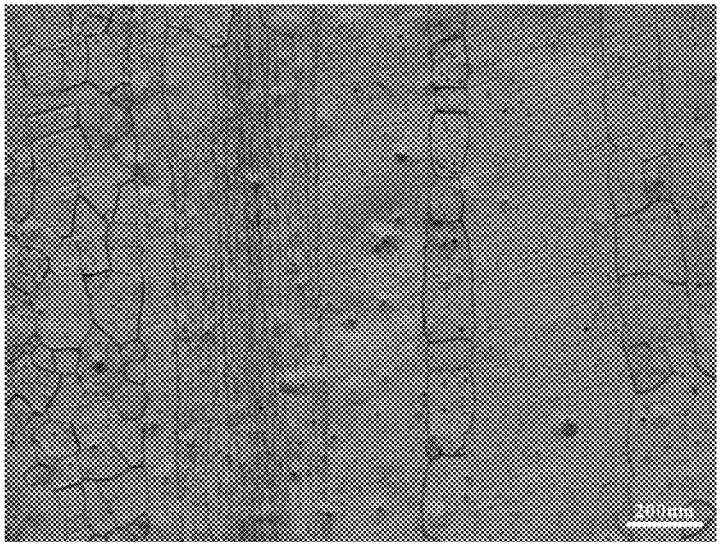
FIG. 5 shows morphology of a crystalline phase structure of a 6××× series aluminum alloy provided by Example 5 of the present application.
Figure 6:
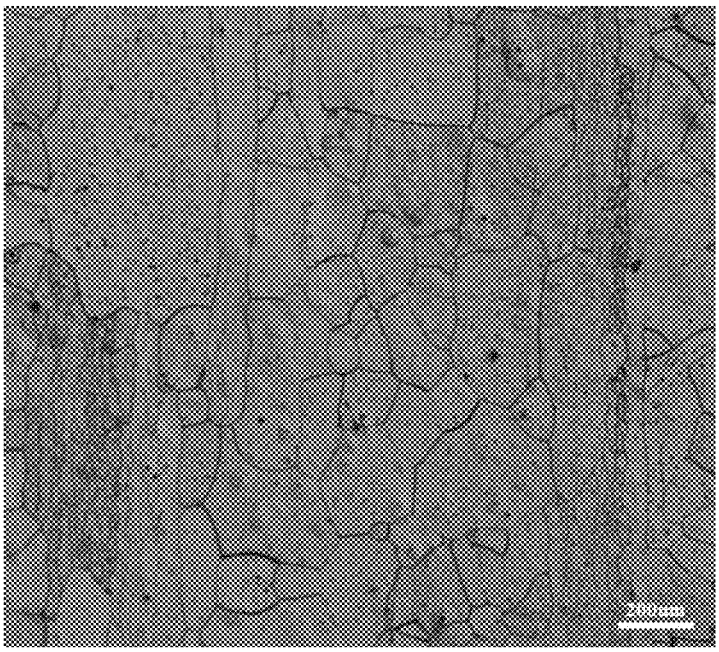
FIG. 6 shows morphology of a crystalline phase structure of a 6××× series aluminum alloy provided by Example 6 of the present application.
Figure 7:
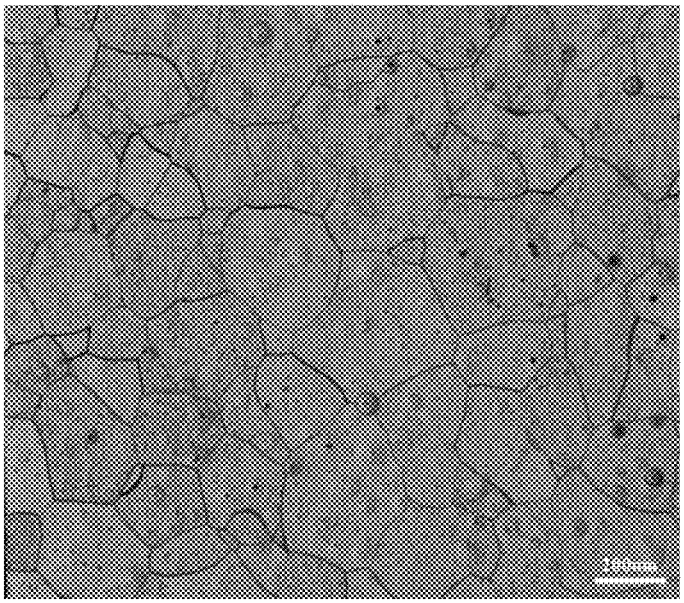
FIG. 7 shows morphology of a crystalline phase structure of an aluminum alloy provided by Comparative Example 1 of the present application.
Figure 8:
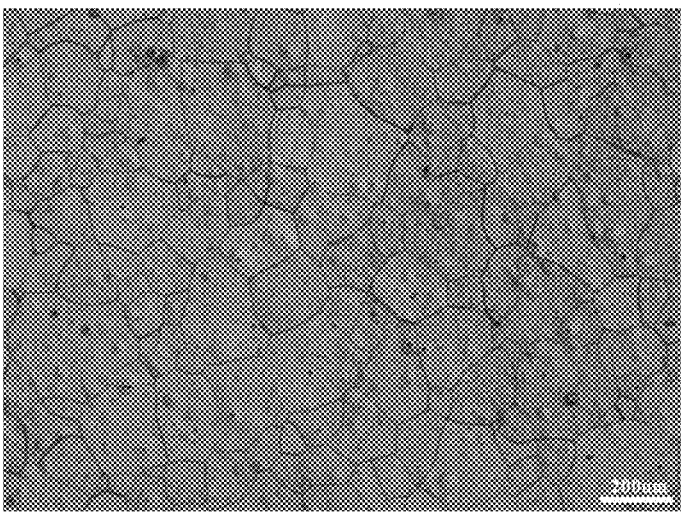
FIG. 8 shows morphology of a crystalline phase structure of an aluminum alloy provided by Comparative Example 2 of the present application.
Figure 9:
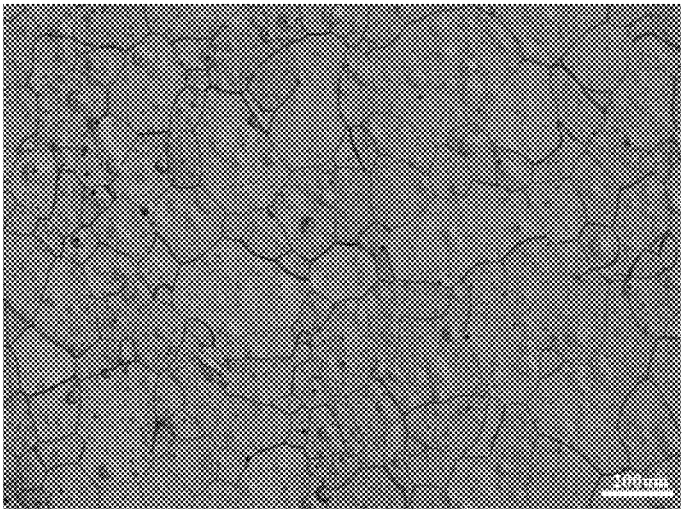
FIG. 9 shows morphology of a crystalline phase structure of an aluminum alloy provided by Comparative Example 3 of the present application.
Figure 10:
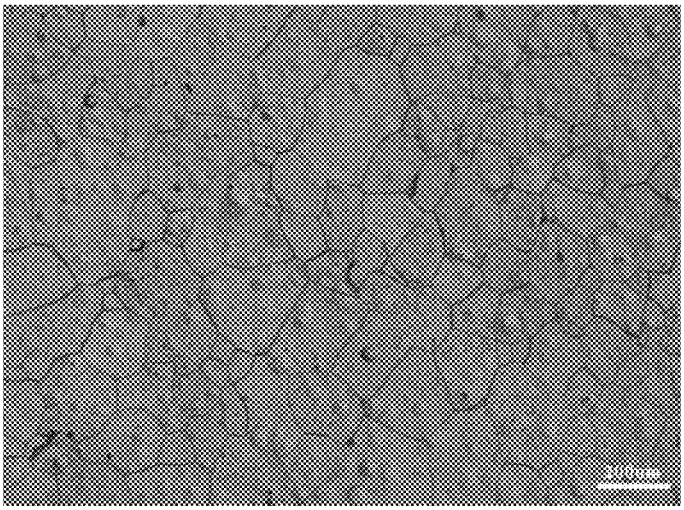
FIG. 10 shows morphology of a crystalline phase structure of an aluminum alloy provided by Comparative Example 4 of the present application.
Figure 11:
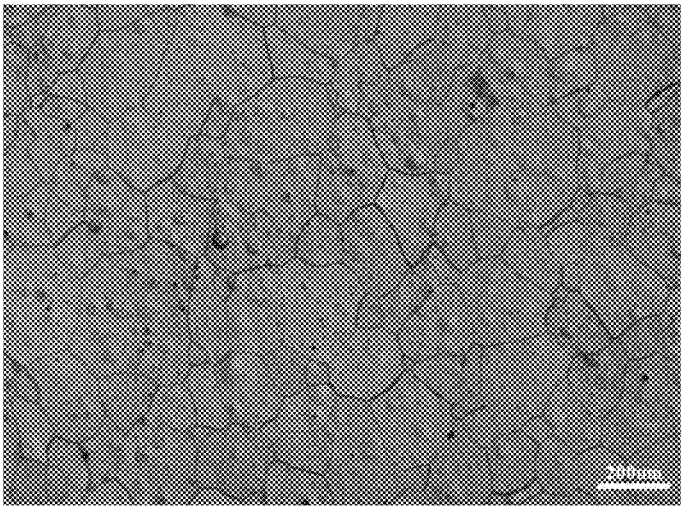
FIG. 11 shows morphology of a crystalline phase structure of an aluminum alloy provided by Comparative Example 5 of the present application.

In the test examples of this application, the morphology of the crystalline phase structure of the aluminum alloy material prepared in Example 1-6 (FIGS. 1-6) and Comparative Example 1-5 (FIGS. 7-11) are examined under a metallographic microscope. As shown in FIGS. 1-11, the aluminum alloy material prepared in Example 1-6 of the present application contains both fibrous crystal phase structure and equiaxed crystal phase structure, while the alloy material of Comparative Example 1-5 contains only equiaxed grain structure. The embodiment of the present application can control the composition and process of the aluminum alloy to make the alloy material form a fibrous crystalline phase structure, which provides additional subcrystalline strengthening effect for the alloy material, thereby effectively improving the mechanical properties of the alloy material.

The above are only optional embodiments of the present application, and are not intended to limit the present application. For those skilled in the art, the present application may have various modifications and changes. Any modification, equivalent replacement, and improvement made within the spirit and principles of this application shall be included in the scope of the claims of this application.

What is claimed is:

1. A 6××× series aluminum alloy material, comprising the following components by weight percentage, based on the definition of the total weight of the 6××× series aluminum alloy material being 100 wt. %:

| | |
|---|---|
| Mg | 0.7-1.1 wt. %, |
| Si | 0.5-1.1 wt. %, |
| Cu | 0.5-1.0 wt. %, |
| Mn | ≤0.15 wt. %, with the weight percentage of Mn excluding 0, |
| Fe | ≤0.10 wt. %, with the weight percentage of Fe excluding 0, |
| Cr | ≤0.10 wt. %, with the weight percentage of Cr excluding 0, |
| Ti | ≤0.05 wt. %, with the weight percentage of Ti excluding 0, |
| Zn | ≤0.05 wt. %, and |

the balance being Al; wherein a total weight percentage of Mn, Cr, and Ti is 0.02-0.25 wt. %, and a total weight percentage of Mn and Fe is 0.02-0.2 wt. %.

the balance being Al;

wherein a total weight percentage of Mn, Cr, and Ti is 0.02-0.15 wt. %, and a total weight percentage of Mn and Fe is 0.02-0.1 wt. %, with the total weight percentage of Mn and Fe excluding 0.1 wt. %;

the 6××× series aluminum alloy material is manufactured by collecting the components according to contents of the corresponding weight percentages as metal raw materials, casting the metal raw materials, and performing homogenization, cooling, extrusion, and aging sequentially, to yield the 6××× series aluminum alloy material;

the step of homogenization comprises: increasing a temperature of the metal materials after the casting to 480-540° C. within 2-12 hrs and keeping such temperature for 2-6 hrs; increasing the temperature to be 540-570° C. within 4-10 hrs; and then increasing the temperature to 570-580° C. and then keeping such temperature for 2-10 hrs;

the 6××× series aluminum alloy material comprises an equiaxed grain structure and a fibrous structure; and a volume ratio of the equiaxed grain structure to the fibrous structure is 1 : (0.5-1.5).

2. The 6××× series aluminum alloy material of claim 1, wherein the 6××× series aluminum alloy material has a yield strength of greater than 430 MPa and a tensile strength of greater than 440 MPa.

3. A mobile terminal, comprising the 6××× series aluminum alloy material of claim 2.

4. The mobile terminal of claim 3, wherein the mobile terminal is a mobile terminal based on 5G communication technology.

5. The 6××× series aluminum alloy material of claim 1, wherein the step of cooling comprises: cooling the metal materials after the homogenization at a temperature of below 300° C. within 3-8 hrs.

6. The 6××× series aluminum alloy material of claim 1, wherein the step of extrusion comprises: extruding the metal materials after the cooling under such conditions: an extruded rod temperature of 510-580° C., an extrusion speed of 3-5 m/min, and an outlet temperature of 520-570° C.

7. The 6××× series aluminum alloy material of claim 1, wherein the step of aging comprises: keeping the metal materials after the extrusion at 170-200° ° C. for 2-24 hrs.

* * * * *